United States Patent [19]

Tsubouchi

[11] Patent Number: 4,498,301

[45] Date of Patent: Feb. 12, 1985

[54] COOLING DEVICE OF STEAM TURBINE

[75] Inventor: Kuniyoshi Tsubouchi, Hitachi, Japan

[73] Assignee: Hitachi, Ltd., Tokyo, Japan

[21] Appl. No.: 466,935

[22] Filed: Feb. 16, 1983

[30] Foreign Application Priority Data

Feb. 17, 1982 [JP] Japan ..... 57-22636

[51] Int. Cl.[3] ..... F01K 17/04

[52] U.S. Cl. ..... 60/657; 60/678; 415/175

[58] Field of Search ..... 60/646, 657, 678, 692, 60/693; 415/175, 178

[56] References Cited

U.S. PATENT DOCUMENTS 1,246,039 11/1917 Baumann ..... 60/657

2,402,841 6/1946 Ray ..... 415/175 X 2,451,261 10/1948 Warren et al. ..... 60/657

*Primary Examiner*—Stephen F. Husar

*Attorney, Agent, or Firm*—Antonelli, Terry & Wands

[57] ABSTRACT

A cooling device for a steam turbine wherein a portion of boiler feedwater for cooling a casing of the turbine is supplied, after being heated by high pressure feedwater heaters, to a cooling fluid passage for the casing as a cooling fluid satisfying the temperature and pressure conditions necessary for effecting cooling of the casing, by a booster pump and a regenerating heat exchanger. After cooling the casing, the cooling fluid is returned to a boiler feedwater system following a heat exchange with a cooling fluid for cooling the casing.

6 Claims, 6 Drawing Figures

COOLING DEVICE OF STEAM TURBINE

BACKGROUND OF THE INVENTION

This invention relates to a cooling device of steam turbines, and more particularly, to a cooling device of a steam turbine of the type suitable for use with a turbine plant of superhigh temperature and pressure.

With a rise in the price of oil as a fuel, a program has been under way all over the world for once again using coal as a fuel. The present tendency of generating plants is to switch from oil to coal as a source of fuel supply. However, the coal-burning fuel power plant suffers the disadvantage that it is lower in overall efficiency than the oil-burning power plant because the rate of auxiliary facilities necessary for carrying out pretreatment of coal and removal of dust from the coal is relatively high. In view of this situation, studies are being conducted on measures for improving the power generating efficiency of coal-burning power plants. To this end, it is known to improve the conditions of steam at the inlet of a steam turbine or to raise the temperature and pressure of the steam. It is known that after the steam at the inlet of a steam turbine attained a pressure of 246 kg/cm$^2$ and a temperature of 566° C., no rise in pressure and temperature has been achieved. This is attributed in part to the fact that the critical temperature of heat resisting ferrite steel accounting for the majority of materials for producing parts of the plants lies in the vicinity of 560° C. However, proposals have been made, as a result of advances made in the progress of technology on heat resisting materials in, to provide turbine plants of superhigh temperature and pressure by using heat resisting austenite steel material so as to greatly improve the heat cycle efficiency of a steam turbine by raising the temperatue and pressure of the steam at the inlet of the steam turbine to high levels.

Some disadvantages are associated, however, with this heat resisting austenite steel material. One of them is that the higher the high temperature strength of the material, the lower become workability and weldability thereof. This is one of the reasons for an increase in the cost of steam plants. Moreover, steam plants of superhigh temperature and pressure pose a problem in that difficulties are encountered in structural design with regard to relieving thermal stresses and accommodating differences in elongation between various structural components, such as turbine casing and piping, because the steam becomes high in pressure when it becomes high in temperature.

An article entitled "First Commercial Supercritical-Pressure Steam turbine" by C. W. Elston et al. appearing in ASME paper, 55A-159, 1955, shows the use of heat resisting austenite steel material for producing a turbine casing which is cooled by steam of low temperature and high pressure obtained by cooling with jet streams of water a portion of the main steam that is branched from the main steam circuit.

Steam plants of high temperature and steam of the prior art described above have suffered the disadvantage of the plant as a whole is low in efficiency because the main steam of high temperature and pressure has its temperature reduced by means of a temperature reducer. The reduction in efficiency is particularly marked when attempts are made to relieve thermal stresses developing in turbine casing, piping and other structural parts because a large amount of cooling steam must be supplied to accomplish the object of cooling.

SUMMARY OF THE INVENTION

This invention has been developed for the purpose of obviating the aforesaid disadvantages of the prior art. Accordingly an object of the invention is to provide a cooling device of a steam plant which minimizes a reduction in the efficiency of a steam turbine plant of superhigh temperature and pressure as a whole.

Another object is to avoid a reduction in the efficiency of the plant as a whole by minimizing the amount of main steam of the boiler which is used for cooling the steam plant.

The outstanding characteristic of the invention is that feedwater for the boiler is used as a cooling medium for the steam turbine of superhigh temperature and pressure.

DETAILED DESCRIPTION

Figure 1:
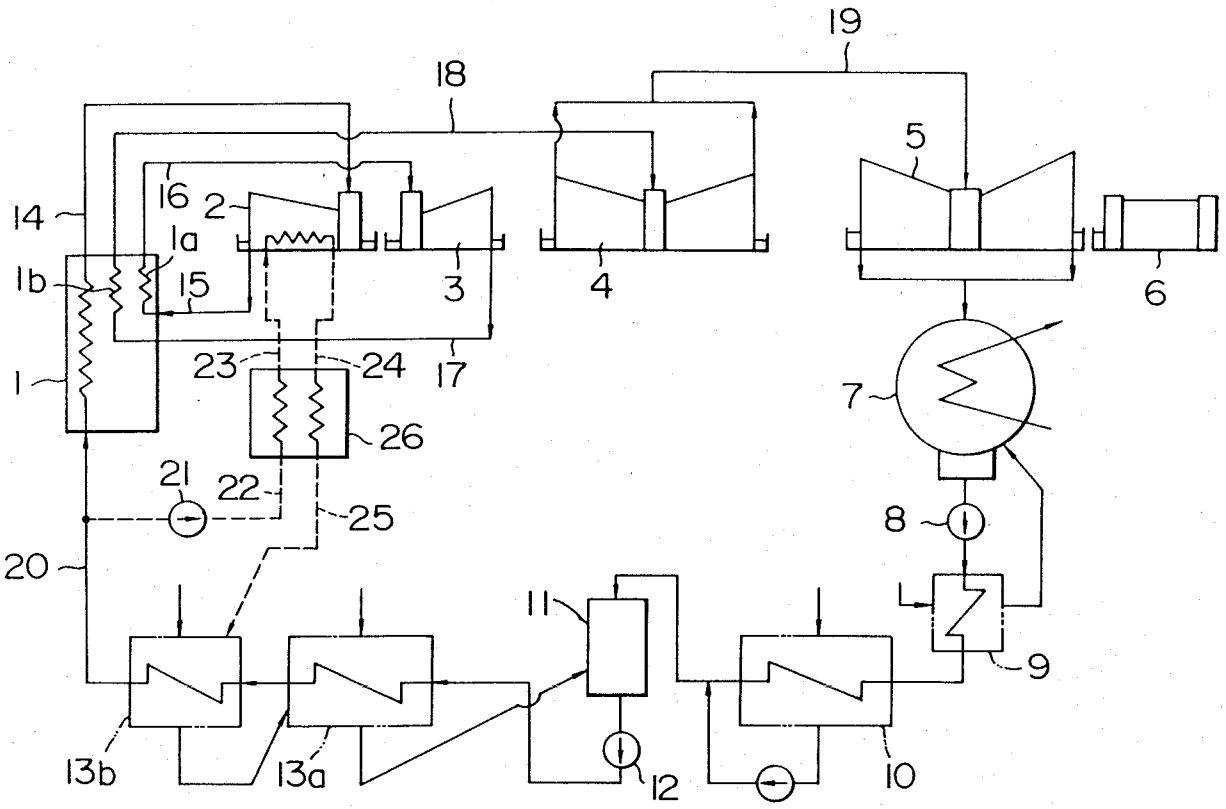
FIG. 1 is a schematic view of the steam turbine plant of superhigh temperature and pressure according to an embodiment of the invention.

Referring now to the drawings wherein like reference numerals are used throughout the various views to designate like parts and, more particularly, to FIG. 1, according to this figure, main steam of superhigh temperature and pressure is generated in a boiler 1 and is supplied to a superhigh pressure turbine 2 through a main steam line 14, and the steam that has done work at the turbine 2 is led to a high pressure turbine 3 through a reheated steam line 16 after being passed through a superhigh pressure exhaust line 15 and is reheated at a high pressure reheater 1*a* of the boiler 1. The steam that has done work at the high pressure turbine 3 is led through a high pressure exhaust line 17 to an intermediate pressure reheater 1*b* of the boiler 1 where it is reheated before being led to an intermediate pressure turbine 4 through a reheated steam line 18. The exhaust from the intermediate turbine 4 is led to a low pressure turbine 5 through a connecting line 19, and the exhaust from the low pressure turbine 5 flows to a condenser 7 where it is cooled into a condensate. The superhigh pressure turbine 2, high pressure turbine 3, intermediate pressure turbine 4 and low pressure turbine 5 are connected together by a single shaft for driving a load such as, for example, a generator 6.

The condensate produced at the condenser 7 and serving as boiler feedwater is fed by a condensate pump 8 through low pressure feedwater heaters 9 and 10 and a deaerator 11 to a feedwater pump 12 which further pressurizes the feedwater and forwards same to high pressure feedwater heaters 13*a* and 13*b* which heat same. Thus, the pressurized and heated feedwater is fed through a boiler feedwater line 20 to the boiler 1. Exhaust or extracted steam of the turbine assembly is led to the low pressure and high pressure feed water heaters 9, 10, 13*a*, 13*b* to heat the feedwater. A cooling fluid system 22 branches from the boiler feedwater line 20 connecting the high pressure feedwater heater 13*b* to the boiler 1 and has mounted therein a booster pump 21 operative to feed a cooling fluid through a regenerating heat exchanger 26 and a high pressure and low temperature cooling fluid system 23 to portions of the superhigh pressure turbine 2 that require cooling. The cooling fluid that has had its temperature raised at the turbine 2 flows through a high temperature cooling fluid system 24 to the regenerating heat exchanger 26 where it dissipates heat before being led through a cooling fluid return passage system 25 to the high pressure feedwater heater 13*b* to serve as a heating source thereof.

In the embodiment of FIG. 1, the cooling fluid is drawn off from the feedwater system 20 immediately before the boiler 1 and is returned to the heating side of the high pressure feedwater heater 13*b*. However, it is to be understood that the invention is not limited to this specific construction of the cooling fluid system 22 and that the cooling fluid may, of course, be drawn off and introduced into the outlet and inlet of a feedwater heat exchanger in dependence upon the temperature of an internal structure of the superhigh pressure turbine 2 and the cooled load 6. Stated differently, the construction of the cooling fluid system is determined by optimum conditions of the heat cycle of the plant.

In FIG. 1, the condensate produced at the condenser 7 is pressurized by the condenser pump 8 and boiler feedwater pump 9, and cooling water 22 obtained by branching a portion of the boiler feedwater and having its temperature raised at the low pressure feedwater heaters 9 and 10 and high pressure feedwater heaters 13*a* and 13*b*, is led to the regenerating heat exchanger 26 after being further pressurized by the booster pump 21. The cooling water 22 has its temperature further raised inside the regenerating heat exchanger 26 by heat exchange with a cooling fluid of the high temperature cooling fluid system 24, and a cooling fluid in the low temperature cooling fluid system 23 is fed to the superhigh pressure turbine 2 as high pressure steam of relatively low temperature or as compressed water of like temperature, to perform the function of cooling the superhigh pressure turbine 2. The cooling fluid, which has its temperature raised in the process of cooling the internal structure of the superhigh pressure turbine 2, is led, as a high temperature cooling fluid, through the system 24 to the regenerating heat exchanger 26, where the high temperature cooling fluid is used as a heating medium for the low temperature cooling fluid. After exchanging heat with the low temperature cooling fluid, the high temperature cooling fluid is led to the high pressure feedwater heater 13*b* through the cooling fluid return passage 25.

The provision of the cooling fluid generating system of the above described construction enables a satisfactory heat protection of the internal structure of the superhigh pressure turbine 2. More specifically, it is to generate cooling steam of high pressure or compressed water for cooling purposes which is lower in temperature than the main steam flowing through the interior of the superhigh pressure turbine 2 and yet has its pressure raised to enable inflow into the superhigh pressure turbine 2. If the high pressure feedwater in the boiler feedwater line 20 is led, as a cooling fluid, to portions of the superhigh pressure turbine 2 that require cooling, the temperature differential between the main steam and the cooling fluid would become too great and increase local thermal stresses. To avoid this phenomenon, the cooling fluid in the low temperature cooling fluid system 23 is heated with a cooling fluid of high temperature by means of the regenerating heat exchanger 26 to bring its temperature to a level lower than the temperature level of the main steam by a predetermined amount of, for example, 50°–100° C.

Figure 2:
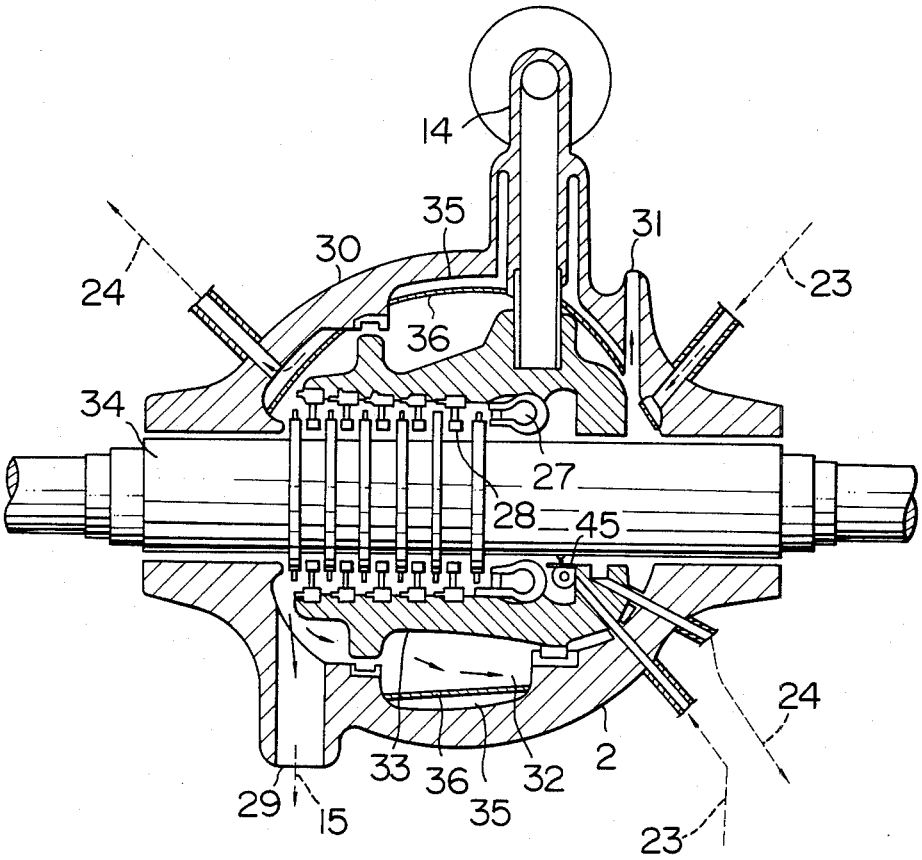
FIG. 2 is a cross sectional view of the turbine of superhigh temperature and pressure.

As shown in FIG. 2, the superhigh pressure turbine 2 comprises the main steam line 14 for introducing steam of superhigh temperature and pressure from the boiler 1 into the interior of the turbine 2, a nozzle box 27 for leading the main steam to turbine stages, a plurality of diaphragms 28 constituting the turbine stages, a turbine rotor 34 supporting turbine movable blades, an inner casing 33 for securing the diaphragms 28 thereto, and an outer casing 30. In the superhigh pressure turbine 2, the superhigh temperature and pressure steam introduced through the main steam line 14 and through the nozzle box 27 into the interior of the turbine 2, is accelerated by stator blades supported by the diaphragms 28 and imparts a rotary force to the turbine rotor 34 while losing energy, so that the pressure and temperature of the main steam is successively lowered. The major portion of the main steam flowing through the turbine stages in this manner is led through an exhaust port 29 to the exhaust line 15 and delivered to the high pressure reheater 1*a* of the boiler 1. However, a portion of the main steam is branched and led to a space defined between the inner casing 33 and outer casing 30, where it is turned to a current of steam 32 for cooling the inner casing 33, which is released through a cooling steam exhaust line 31 from the outer casing 30 to outside. The current of steam 32 is kept in a relatively high temperature condition although it loses its temperature and pressure while flowing through the turbine stages, so that the outer casing 30 might not be protected sufficiently from heat. It is important that the outer casing 30 be protected satisfactorily from heat particularly because steam of superhigh temperature flows through the main steam line 14 and heat of high temperature level is transferred from the main steam line 14 to the outer casing 30 by conduction of heat. However, the use of material of high thermal strength for producing the outer casing 30 would involve a marked rise in cost because such material is expensive and is low in workability. Thus, it is preferable that the outer casing 30 be protected from heat by cooling the same with a fluid while using material of relatively low resistance to heat of the prior art for producing the same. More specifically, as shown in FIG. 1, the feedwater branching from the feedwater system down-stream of the feedwater pump 12 and having its pressure raised is led, after being further pressurized by the booster pump 21, to the regenerating heat exchanger 26 through the cooling fluid system, and is subjected to heat exchange at the regenerating heat exchanger 26 with a fluid heated at the superhigh pressure turbine 2 and led out through the high temperature cooling fluid system 24, to thereby produce a low temperature cooling fluid lower in temperature than the main steam by a predetermined value.

Figure 3:
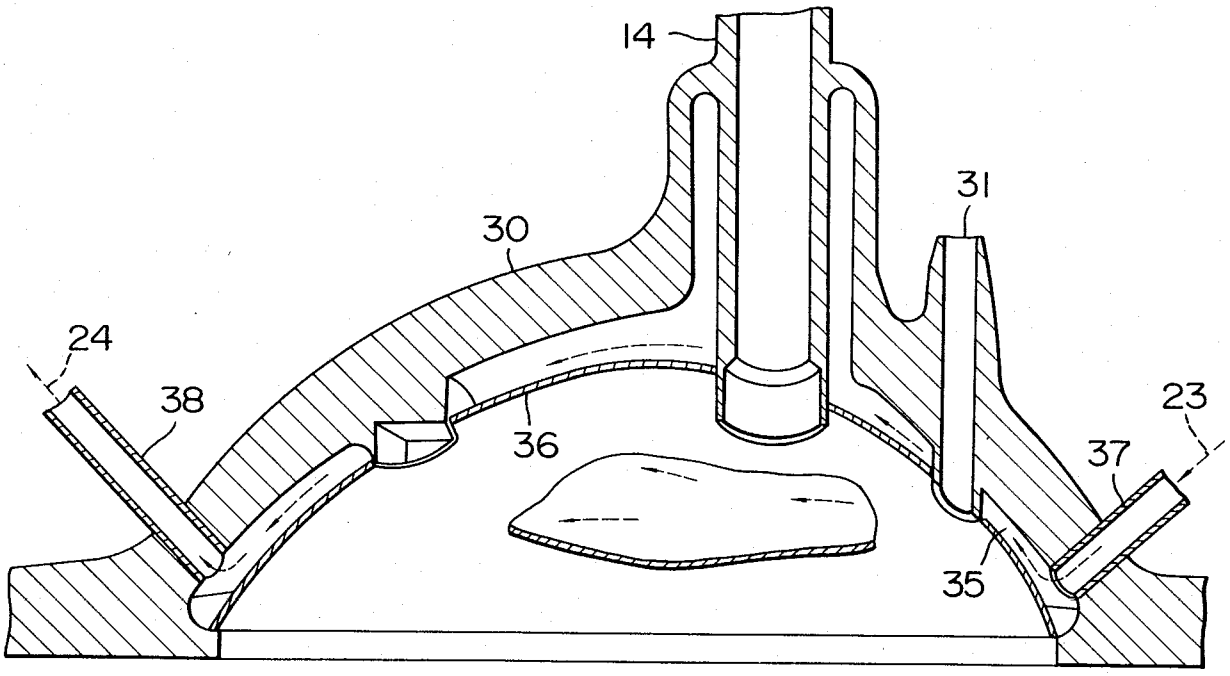
FIG. 3 is a cross sectional view of the casing of the turbine of superhigh temperature and pressure.

The low temperature cooling fluid has its pressure raised because it is necessary to introduce same into the superhigh temperature and pressure turbine 2. The low temperature cooling fluid of high pressure produced at the regenerating heat exchanger 26 is led through the low temperature cooling fluid system 23 to the interior of the superhigh temperature and pressure turbine 2, so that it flows into a cooling fluid passage 35 defined between a partition wall 36 spaced apart from an inner wall surface of the outer casing 30 by a gap of a predetermined size and the outer casing 30 so as to provide a sort of heat insulating layer to keep the outer casing 30 cool. The cooling fluid passage 35 is shown in detail in FIG. 3 in which an inlet pipe 37 and an outlet pipe 38 communicated with the low temperature cooling fluid system 23 and high temperature cooling fluid system 24, respectively, of the regenerating heat exchanger 26 shown in FIG. 1 are kept in communication with the outer casing 30, and the partition wall 36 is located facing the inner wall surface of the outer casing 30 to define therebetween the fluid passage 35 which is separated from the fluid located inwardly of the outer casing 30 by the partition wall 36. By using the cooling means of the above described construction, it is possible to effect satisfactory cooling of the inner wall surface of the outer casing 30 and the joint between the main steam line 14 and the outer casing 30. It is also made possible by the use of the cooling means of the above-described construction to use material of prior art of relatively low resistance to heat for producing the outer casing 30 of the superhigh temperature and pressure turbine 2.

The partition wall 36 is not required to have high mechanical strength and may be formed of heat resisting steel plates of relatively small thickness because the fluids inside and outside thereof are substantially equal in pressure.

Figure 4:
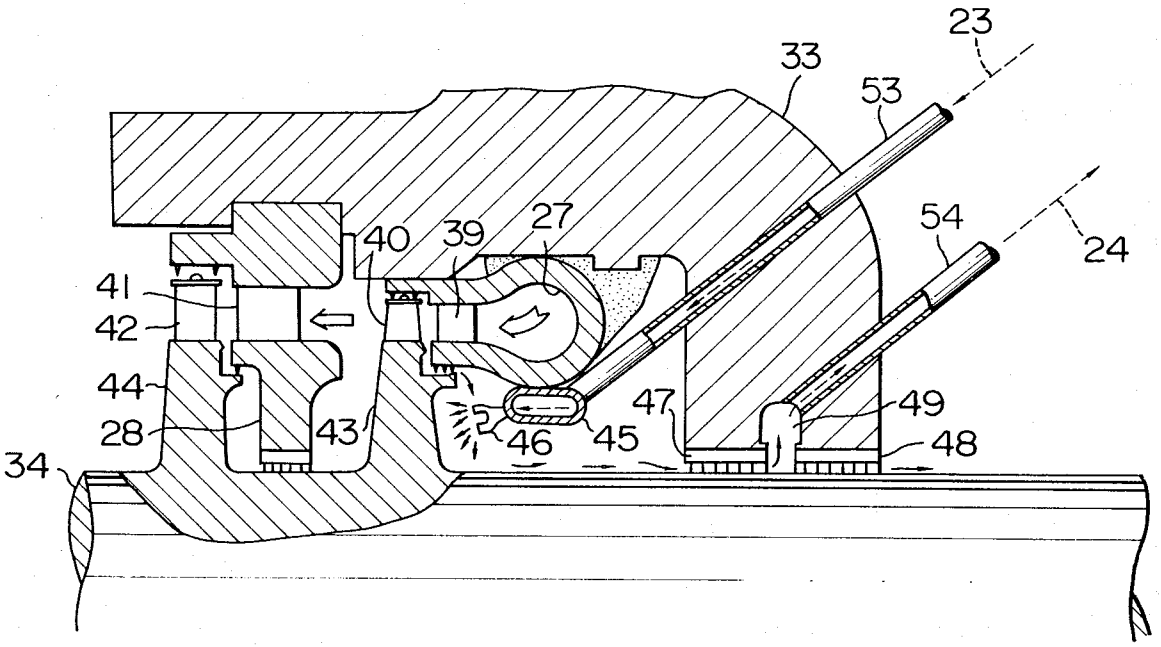
FIG. 4 is a cross sectional view of the rotor disc section of the turbine of superhigh temperature and pressure.

Generally, discs of steam turbines, not only of superhigh pressure steam turbines but also of usual steam turbines, are exposed to severe working conditions from the point of view of strength of materials due to high centrifugal forces and thermal stresses produced by the differential in atmospheric temperature before and after the disc. Cooling of the rotor disc inside the superhigh pressure turbine 2 plays an important role is easing the severe conditions. FIG. 4 shows a portion of a turbine stage structure comprising the nozzle box 27 secured to the inner casing 33, a stator blade 39 located at an outlet section of the nozzle box 27, movable blades 40 and 42 respectively supported by discs 43 and 44 on the outer circumferential surface of the turbine rotor 34, the diaphragm 28 secured to the inner casing 33, and a stator blade 41 secured to the diaphragm 28. A cooling fluid introducing pipe 53 is provided for introducing high pressure steam or a low temperature cooling fluid of high pressure supplied from the regenerating heat exchanger 26 through the low temperature cooling fluid system 23 shown in FIG. 1 into a space enclosed by a lower portion of the nozzle box 27 and the turbine rotor 34, and a distributor pipe 45 of a circular shape, in communication with the introducing pipe 53, is mounted in the space below the nozzle box 27. A plurality of cooling fluid ejecting nozzles 46 are mounted on the outer periphery of the distributor pipe 45 at a suitable spacing and directed against the disc 43 of the turbine rotor 34. A low temperature cooling fluid, ejected through the cooling fluid nozzles 46 against the disc 43, exchanges heat with the atmosphere and rises in temperature to become a high temperature cooling fluid in the form of steam. To use this fluid as a heat source for the regenerating heat exchanger 26 shown in FIG. 1, means are provided for releasing it through a seal mounted between the inner casing 33 and turbine rotor 34 of the aforesaid turbine stage structure into the high temperature cooling fluid system 24 shown in FIG. 1. More specifically, a labyrinth packing, mounted at the boundary between the inner casing 33 and turbine rotor 34, is divided into a high pressure labyrinth packing section 47 and a low pressure labyrinth packing section 48 in the inner casing 33 at a position surrounding the outer circumferential surface of the turbine rotor 34. Additionally, a discharge space 49 is formed at the inner circumferential surface of the inner casing 33 for discharging therein the fluid leaking from the high pressure labyrinth packing section 47, and a discharge pipe 54 is connected to the discharge space 49 to maintain the discharge space 49 in communication with the high temperature cooling fluid system 24 connected to the heating side of the regenerating heat exchanger 26 shown in FIG. 1. By virtue of this construction, the low temperature cooling fluid of high pressure produced by the regenerating heat exchanger 26 in the form of steam of high pressure and low temperature can be directed against the rotor disc 43 through the distributor pipe 45 and cooling fluid nozzles 46, to thereby effectively cool the disc 43 of the turbine rotor 34. Also, leaks of high temperature fluid through the root of stator blade 39 at the outlet section of the nozzle box 27 can be minimized, and leaks from the inner casing 33 through the labyrinth packing sections 47 and 48 to outside can be minimized while the temperature of the leaks can be reduced.

When cooling of the rotor disc 43 is carried out by directly directing a cooling fluid thereagainst, the cooling fluid flowing through the low temperature cooling fluid system 23 should be in the form of high pressure steam of low temperature. However, when the rotor of the superhigh turbine is formed of material of high thermal resistance, it is only necessary to cool the casing 30. When this is the case, it is possible to use feedwater of high pressure as a cooling fluid flowing through the system 23 by completely partitioning the interior of the casing 30 by the partition wall 36 to separate same from the space into which the main steam is supplied. When feedwater of high pressure is used as a cooling fluid, the cooling fluid channel formed in the casing 30 may have the construction shown in FIG. 5.

Figure 5:
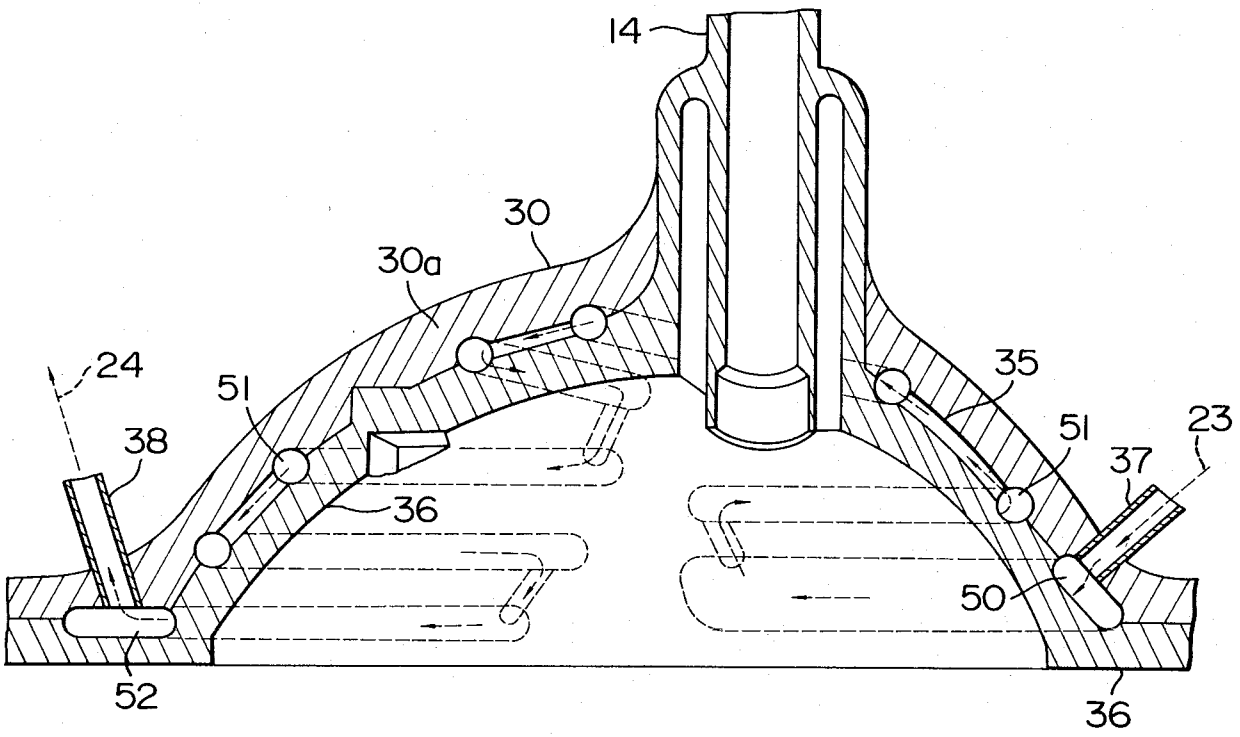
FIG. 5 is a cross sectional view of the casing of the turbine of superhigh temperature and pressure.

More particularly, as shown in FIG. 5, the outer casing 30 is of dual structure and comprises an external outer casing portion **30*a* and an internal outer casing portion 36, and a cooling fluid channel comprising channel section 51 and 52 maintaining the inlet pipe 37 connected to the low temperature cooling fluid system 23 in communication with the outlet pipe 38 connected to the high temperature cooling fluid system 24 is provided between the external outer casing portion 30*a* and internal outer casing portion 36, to thereby satisfactorily protect the outer casing 30** from heat.

In the embodiment of FIG. 5, the main steam lime 14 is joined by welding to the internal outer casing portion 36 which separates the main steam from the cooling fluid. This is conducive to complete isolation of the cooling fluid from the main steam.

Figure 6:
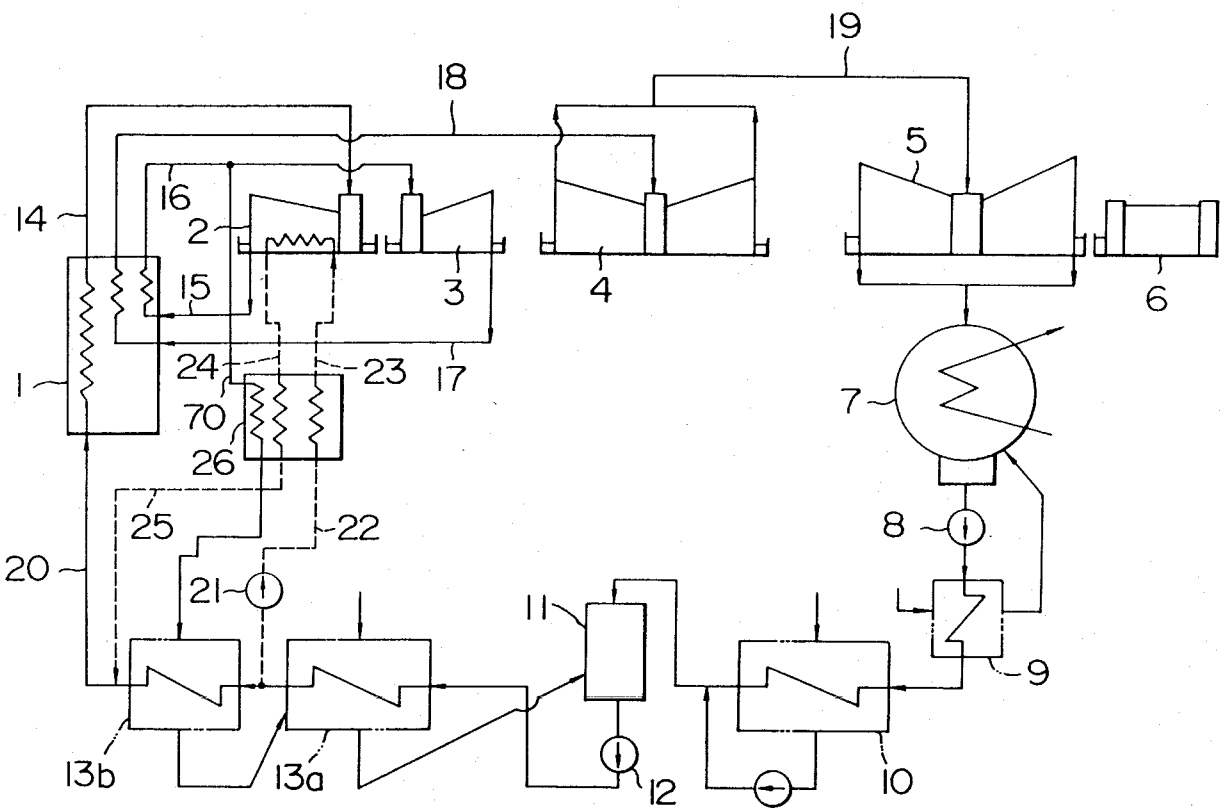
FIG. 6 is a schematic view of the steam turbine plant of superhigh temperature and pressure according to another embodiment of the present invention.

In the embodiment shown in FIG. 1, the cooling fluid is obtained by branching a cooling fluid system from the feedwater system at the outlet of the high pressure feedwater heater and is recovered on the heating side of the high pressure heater. This construction may be modified as shown in FIG. 6 wherein the cooling fluid system branches from between the high pressure feedwater heaters **13*a* and 13*b* and the cooling fluid is recovered by returning the same to the feedwater line 20 at the outlet of the high pressure feedwater heater. In FIG. 6, a portion of the high pressure regenerating steam may be led to the regenerating heat exchanger 26 through a bypass line 70 for heating the cooling fluid, and the cooling fluid flowing through the high temperature cooling fluid system 24** may be used as high pressure steam of low temperature.

From the foregoing description, it will be appreciated that the cooling device of a steam turbine according to the invention enables heat resistant steel material of relatively low class to be used for producing structural components of a steam turbine of superhigh temperature and pressure except those which are brought into direct contact with superhigh temperature steam without in any way reducing the reliability of the structure. The invention also makes it possible to utilize heat of the turbine for heating a cooling fluid through a regenerating heat exchanger after such heat is obtained by cooling the turbine by the cooling device according to the invention and to recover heat from the feedwater system, to thereby minimize a reduction in the operation efficiency of the plant.

What is claimed is:

1. A cooling device for a steam turbine, the cooling device comprising:

condenser means for condensing steam supplied from the steam turbine;

feedwater means for supplying feedwater from the condenser means to a boiler means;

a first cooling fluid means branching from the feedwater means for supplying a portion of the feedwater to to the steam turbine as a cooling fluid; and a second cooling fluid means communicating with said first cooling fluid means and including a regenerating heat exchanger means for heating the cooling fluid, said second cooling fluid means being connected to the steam turbine so that the cooling fluid heated by said heat exchanger means is supplied to portions of the steam turbine requiring a cooling.

2. A cooling device for a steam turbine as claimed in claim 1, further comprising a cooling fluid return passage means connected to said regenerating heat exchanger means for introducing a heated cooling fluid that has cooled the portions of said steam turbine requiring cooling into a heating side of said regenerating heat exchanger means and for supplying said cooling fluid to said feedwater means.

3. A cooling device for a steam turbine as claimed in claim 1, wherein said feedwater means includes a feedwater pump means, and wherein said first cooling fluid means branches off from the feedwater means at a position downstream of the feedwater pump means.

4. A cooling device as claimed in claim 1, further comprising a partition means wall located in a spaced juxtaposed relation to an inner wall surface of an outer casing of the steam turbine, said partition means cooperating with said outer casing to define therebetween a space for introducing the cooling fluid therein.

5. A cooling device of a steam turbine as claimed in claim 4, wherein said second cooling fluid means and a heating side cooling means are connected to the outer casing of said steam turbine, said second cooling fluid means and said heating side cooling means being maintained in communication with said space defined between the inner wall surface of the outer casing and said partition means.

6. A cooling device of a steam turbine as claimed in claim 1, further comprising a distributor pipe means arranged around a turbine rotor within the steam turbine and maintained in communication with said regenerating heat exchanger means through said second cooling fluid means to receive the cooling fluid supplied therethrough, and a plurality of nozzle means located in spaced juxtaposed relation to a disc of the turbine rotor to direct thereto currents of the cooling fluid.

* * * * *